US005509291A

United States Patent [19]

Nilsson et al.

[11] Patent Number: 5,509,291

[45] Date of Patent: Apr. 23, 1996

[54] CRIMPING TOOL

[75] Inventors: Mikael Nilsson; Mats Norin, both of Älvdalen, Sweden

[73] Assignee: Pressmaster Tool AB, Alvdalen, Sweden

[21] Appl. No.: 313,303

[22] PCT Filed: Apr. 5, 1993

[86] PCT No.: PCT/SE93/00291

§ 371 Date: Oct. 6, 1994

§ 102(e) Date: Oct. 6, 1994

[87] PCT Pub. No.: WO93/19897

PCT Pub. Date: Oct. 14, 1993

[30] Foreign Application Priority Data

Apr. 6, 1992 [SE] Sweden ..... 9201087
Feb. 19, 1993 [SE] Sweden ..... 9300564

[51] Int. Cl.[6] ..... H01R 43/042

[52] U.S. Cl. ..... 72/409.14; 72/451; 29/751; 81/313; 81/376; 81/380

[58] Field of Search ..... 72/410, 409, 451; 29/751; 81/376, 378, 380, 313

[56] References Cited

U.S. PATENT DOCUMENTS

| | | | |
|---|---|---|---|
| 2,519,630 | 8/1950 | Boyer | 81/84 |
| 2,752,812 | 7/1956 | Steine | 81/186 |
| 3,157,075 | 11/1964 | Filia | 81/313 |
| 3,170,345 | 2/1965 | Poingt et al. | 81/15 |
| 4,526,070 | 7/1985 | Wiener | 72/410 |
| 5,280,716 | 1/1994 | Ryan | 81/313 |

FOREIGN PATENT DOCUMENTS

| | | |
|---|---|---|
| 0417025 | 3/1991 | European Pat. Off. . |
| 2602491 | 10/1976 | Germany . |
| 2555071 | 4/1982 | Germany . |
| 3708727 | 7/1988 | Germany . |
| 75209564 | 7/1976 | Taiwan . |
| 74202005 | 7/1976 | Taiwan . |
| 77201670 | 11/1988 | Taiwan . |
| 79205317 | 4/1990 | Taiwan . |
| 79203407 | 8/1990 | Taiwan . |
| 79204316 | 9/1990 | Taiwan . |
| 79204847 | 9/1990 | Taiwan . |
| 1522144 | 8/1978 | United Kingdom . |
| 2251568 | 7/1992 | United Kingdom . |
| WO88/00516 | 1/1988 | WIPO . |
| WO94/19154 | 9/1994 | WIPO . |

*Primary Examiner*—Daniel C. Crane
*Attorney, Agent, or Firm*—Jacobson, Price, Holman & Stern

[57] ABSTRACT

A crimping tool includes first and second jaws (1, 2) which are journalled at a first pivot point (5) for pivotal movement relative to one another. A forward end of a first handle (6) is rigidly connected to the first jaw (1), while a forward end of a second handle (7) is pivotally connected to the second jaw (2) at a second pivot point (8). A linkage construction (9) extends obliquely rearwards from a third pivot point (10) located on the second handle (7) rearwardly of the second pivot point (8), up to a fourth pivot point (11) on the first handle (6). The distance (D) between the first and the second pivot points (5, 8) is 0.30–0.35 times the distance (A) between the first and the fourth pivot points (5, 11), the distance (C) between the second and the third pivot points (8, 10) is 0.20–0.25 times the distance (A) between the first and the fourth pivot points (5, 11), and the distance (B) between the third and the fourth pivot points (10, 11) is 0.62–0.66 times the distance (A) between the first and the fourth pivot points (5,11). In the closed position of the jaws (1, 2) a plane (E) which contains the second and the third pivot points (8, 10) defines an angle (α) of 165°–180° with a plane (F) which contains the third and the fourth pivot points (10, 11), with the apex of the angle facing away from the first handle (6).

21 Claims, 5 Drawing Sheets

CRIMPING TOOL

This application is a 371 of PCT/SE93/00291, filed Apr. 5, 1993.

The present invention relates to a crimping tool for, e.g., manually crimping electrical terminal contacts onto the ends of cables, and being of the kind which includes first and second crimping jaws each of which is provided with an individual crimping part and which are journalled in relation to one another at a first pivot point for pivotal movement between an open position and a closed crimping position, and which includes first and second handles which are intended for pivoting the jaws and which extend rearwardly from said jaws, wherein the first handle is rigidly connected to the first jaw at a front end of said first handle whereas the second handle is pivotally connected to at least a par: of the second jaw at a front end of the handle in a second pivot point located rearwardly of the first pivot point, and wherein a linkage construction extends obliquely rearwards from a third pivot point on the second handle, rearwardly of said second pivot point, up to a fourth pivot point on the first handle.

Such tools (see for instance GB-A-1 522 144 and DE-C-2 555 071) are used to a large extent in the manufacture and installation of electrical and electronic devices. When using these known tools, it is necessary to exert relatively considerable force in order to complete the crimping operations concerned, resulting in tiredness of the tool operator and in the risk of causing bodily strain to an operator who is required to carry out such operations regularly.

The present invention is based on the problem of providing a novel and advantageous crimping tool of the kind defined in the introduction, whose construction is such that the tool will be essentially optimized from an ergonomical aspect, so as to eliminate at least substantially the problems associated with such tools.

With the intention of solving the aforesaid problem, it is proposed in accordance with the invention that the distance between the first and the second pivot points is 0.30–0.35 times the distance between the first and the fourth pivot points, that the distance between the second and the third pivot points is 0.20–0.25 times the distance between the first and fourth pivot points, and that the distance between the third and the fourth pivot points is 0.62–0.66 times the distance between said first and said fourth pivot points, and that in the closed crimping position of the jaws a plane which contains the second and the third pivot points, with the an angle within the range of 165°–180° with a plane which contains the third and the fourth pivot points, with the apex of the angle facing away from a plane that contains the first and the fourth pivot points.

Other objects of the invention are to provide a crimping tool which is constructed of flat parts, to provide a crimping tool which is capable of gripping objects, for instance a cable end and a cable shoe which is to be crimped onto said cable end, so that a two-hand grip can be used if so desired, and to provide a crimping tool which is provided with an improved marking device for indicating that a crimping tool movement has been completed. These and other objects described in the following description are achieved with a crimping tool having the characteristic features set forth in the depending claims.

The invention will now be described in more detail with reference to chosen exemplifying embodiments thereof and also with reference to the accompanying drawings.

Figure 1:
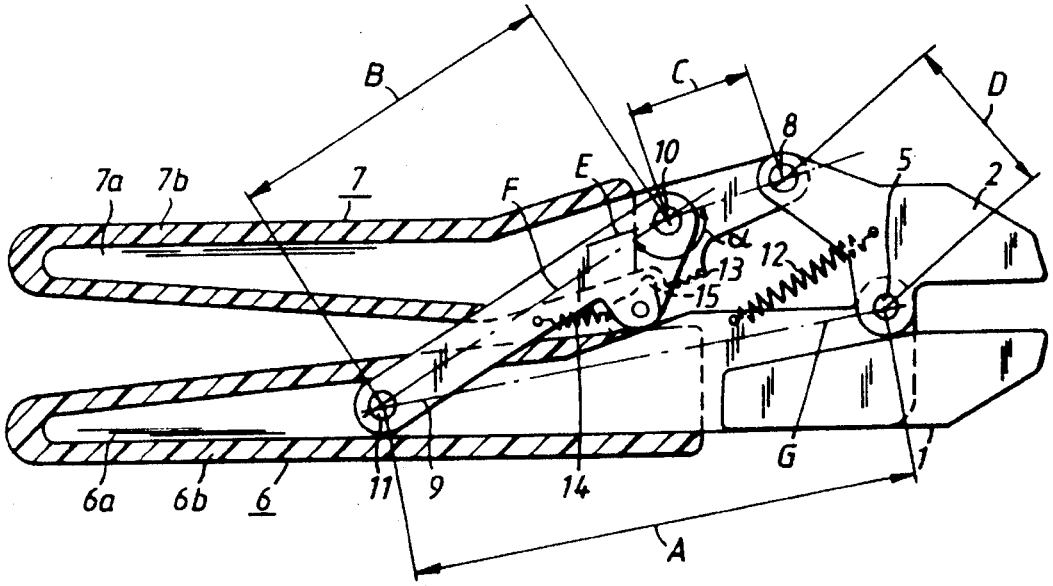
FIGS. 1–3 illustrate schematically and in side view a first, second and third embodiment of the inventive crimping tool respectively.

All identical or essentially identical tool elements shown in the drawings have been identified with the same reference signs.

FIG. 1 illustrates a closed crimping tool which includes first and second jaws 1,2 which are intended to carry jaw inserts which function, for instance, to crimp terminal contacts onto electrical conductors. Such jaw inserts are shown only in FIG. 3 and are there referenced 3 and 4. The jaws 1,2 are journalled at a first pivot point 5 for pivotal movement relative to one another between the illustrated, closed position and an open position (not shown) which enables, for instance, a cable end and a terminal contact to be crimped onto the cable end to be inserted between the inserts 3, 4 on the open jaws. The tool also includes first and second handles, generally referenced 6 and 7 respectively, which extend rearwardly from the jaws 1, 2. Each handle is comprised of a metal handle body *6a, 7a* which in the regions intended to be held by the user during a crimping operation are provided with outer coverings or outer handles *6b, 7b,* which are made of a plastic material for instance and have a grip-friendly shape. The first handle is rigidly connected to the first jaw 1. In the illustrated embodiment, a forwardly extending part of the handle body *6a* forms a rear part of the jaw 1 and the first pivot point 5 is located on this part of the handle body. The other handle 7 is pivotally connected to the second jaw 2 by means of a second pivot point 8 located at a forward end of the handle, wherein the second pivot point 8 is located rearwardly of the first pivot point 5. A linkage construction 9 extends obliquely rearwardly from a third pivot point 10 located on the second handle 7 rearwardly of the second pivot point 8, up to a fourth pivot point 11 on the first handle 6.

In order to provide a crimping tool with essentially optimum ergonometric properties, the distance D between the first and the second pivot points 5,8 is 0.30–0.35 times, suitably about 0.32 times the distance A between the first and the fourth pivot points 5,11, while the distance C between the second and the third pivot points 8,10 is 0.20–0.25 and suitably about 0.24 times the distance A, and the distance B between the third and the fourth pivot points 10,11 is 0.62–0.66, suitably about 0.64 times the distance A. In the closed position of the tool, a plane E extending perpendicularly to the plane of the drawing and containing the pivot points 8 and 10 defines an angle $\alpha$ within an angular range of 165°–180° with a plane F that contains the pivot points 10 and 11, with the apex of the angle facing away from a plane G that contains the pivot points 5,11.

In the case of the illustrated embodiments, the tool handle bodies *6a, 7a* are located in mutually the same plane, and the linkage construction 9 is comprised of two similarly planar and mutually identical linkage arms which are each located on a respective side of the handle bodies and of which the linkage arm located nearest the viewer of FIGS. 1–3 and 5 and 7 hides the linkage arm located behind the linkage arm visible in the drawings. A portion 7*ac* (FIGS. 2,8,10,11) of the second handle body 7*a* located rearwardly of the third pivot point 10 may to advantage be located between and extend substantially in parallel with the two linkage arms of the linkage construction 9 in the closed crimping position of the toot. The handle body 7*a* is then curved so as to extend substantially in parallel with the first handle 6. Suitably, said portion 7*ac* has a length of the order of magnitude of half the distance between the pivot points 10 and 11. This arrangement, particularly in combination with the location of the pivot point 8 rearwardly of the pivot point 5 in the closed position of the tool, enables the distance between the handles 6 and 7 to be chosen to become particularly advantageous from an ergonomical aspect both in the open position and the closed position of the tool.

The first jaw 1 includes two plates 1*c* which are firmly connected to a respective side of the handle body 6*a* (see in particular FIG. 4) and between which a crimping part 3 (FIG. 3) is intended to be fixed. Similarly, the second jaw 2 includes two plates 2*c* each of which is located on a respective side of the handle bodies 6*a* and 7*a*, (see in particular FIG. 6) and which are journalled for pivotal movement in relation to both the body 6*a* and the body 7*a* and between which a crimping part 4 (FIG. 3) is intended to be fixed. The construction of the tool components in the form of flat or plate-like elements is favourable from the aspect of mechanical strength. As will be seen from FIGS. 4 and 6, the handle body 6*a*, 7*a* may be constructed from two flat parts 6*aa*, 6*ab* and 7*aa*, 7*ab* which are placed side-by-side at a short distance apart.

The reference numeral 12 in FIG. 1 identifies a pull spring which functions to pivot the jaw 2 anti-clockwise around the pivot point 5 and therewith pivot the handle 7 clockwise around the pivot point 10 unless the handle 6, 7 are pressed towards the tool closing position. In order to prevent, in a known manner, interruption of a crimping operation before the jaws 1, 2 have been swung to their fully closed position, or to prevent interruption of a tool opening movement, the handle 7 is provided with a toothed ring part 13 which is concentrical with the point 10 and which is intended to coact with a latch pawl 15 pivotally journalled on the linkage construction 9 and pivoting against the action of a pull spring 14. It will be understood that the pawl 15 must be located either forwardly or rearwardly of the toothed ring part before the tool can be closed or opened. Such an arrangement is illustrated in and described in, for instance, the patent specifications mentioned in the introduction.

In order to enable the jaws to be set to a desired closed position and to adjust the closed position of the tool when the tool becomes worn, in a similarly known manner, one of the journal pins at the pivot points, suitably the pivot pin at the pivot point 10 is provided in a known manner (not illustrated here) with a cylindrical part journalled centrally in one handle body and two cylindrical parts which are located on opposite sides of the central part and which, depending on the position of the journal pin, are journalled in the two linkage arms of the linkage construction 9 or in the plates 2*c* on the jaw 2 and which are mutually coaxial but eccentrical in relation to said central part. The journal pin for adjusting the desired jaw closed position is therewith rotatable and lockable in the set position of rotation. Such an arrangement is illustrated and comprehensively described in, for instance, the patent specifications mentioned in the introduction.

The tool illustrated in FIG. 1 is opened automatically by the pull spring 12. When performing a crimping operation, the objects to be crimped, for instance a terminal contact fitted to the end of a bared cable end, is inserted between the crimping parts 3, 4 of the fully open jaws 1,2 (not shown in FIG. 1), whereafter the handles are swung towards one another while manually holding said objects in position between the jaws until the pawl 15 lies behind the toothed ring part 13, wherewith the crimping operation is complete. It will be understood that the linkage construction 9 and the pivotal handle 7 form a toggle mechanism which when pivoting the handle 7 anticlockwise with a moderate force causes the second jaw 2 to pivot clockwise with a greater force during a crimping operation. In order to avoid damage to the tool, the tool will preferably have a certain degree of resiliency, while at the same time ensuring that a requisite crimping force will definitely be achieved. Preferably, the tool will have an intrinsic resiliency such that the jaws 1, 2 can swing apart through an angle of 5°, preferably an angle of about 10°, from a closed crimping position brought about by means of the handles 6, 7, without any residual deformation of the tool. In a corresponding manner the handles 6, 7 shall be able to swing to the closed position without any residual deformation of the tool, even if an incompressible object between the jaws 1, 2 maintains said jaws swung apart an angle of up to 5° or 10°, respectively.

Figure 2:
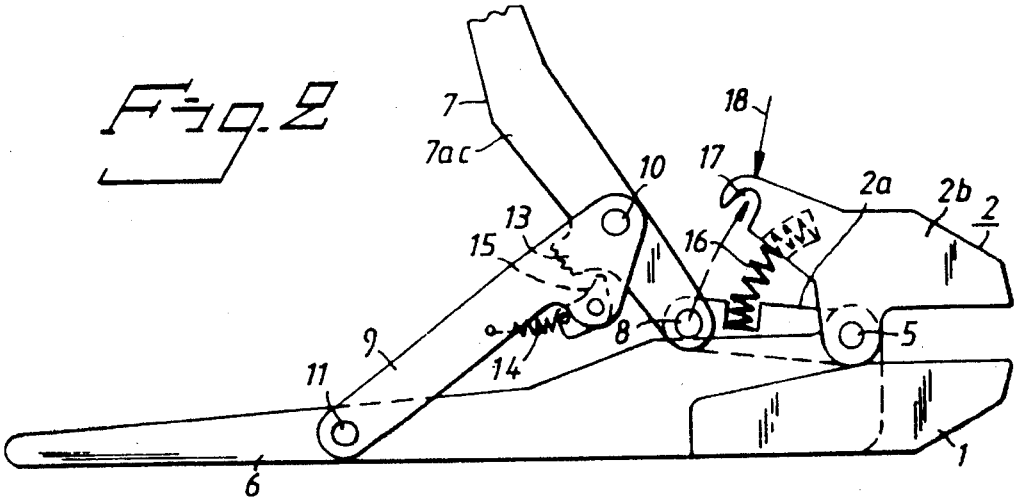

FIG. 2 illustrates a tool embodiment which enables an object, for instance a terminal contact, to be firmly clamped between the crimping parts 3, 4 of the jaws 1,2 prior to swinging the handles 6, 7 towards one another, for instance, so that the handles can be swung towards each other with a two-hand grip. To this end, the crimping jaw 2 is comprised of a first jaw part 2*a* in the form of a linkage arm which extends between the pivot points 5 and 8 and a second jaw part 2b which is intended to carry the crimping part 4 and which is journalled at the pivot point 5. A pressure spring 16 acting between the jaw parts 2*a* and 2*b* functions to swing both the jaw part 2*b* and the handle 7 clockwise around respective pivot points 5 and 10. A journal pin mounted in the pivot point 8 projects out on both sides of the handle 7 and is intended to be received in recesses 17 in the jaw part 2*a*, at least at the end of a crimping operation. The tool illustrated in FIG. 2 will thus normally take the position shown in the Figure. An object is clamped between the jaws, by pressing down the jaw part 2*b* in the direction of the arrow 18 against the action of the spring 16, whereupon the object is inserted between the jaws and the jaw part 2*b* is permitted to swing back towards the closed position. The handle 7 is then swung anticlockwise against the action of the spring 16, wherein the journal pin extending through the pivot point 8 gradually engages the recesses 17 and swings the jaw part 2*b* to its fully closed position, in which the latching pawl 15 is located behind the toothed ring part 13. In other respects, the tool is constructed in the manner described with reference to FIG. 1. The rear end of the linkage arm 2*a* is received in a space between the parts 7*aa*, 7*ab* forming the handle 7 (FIG. 6).

Figure 3:
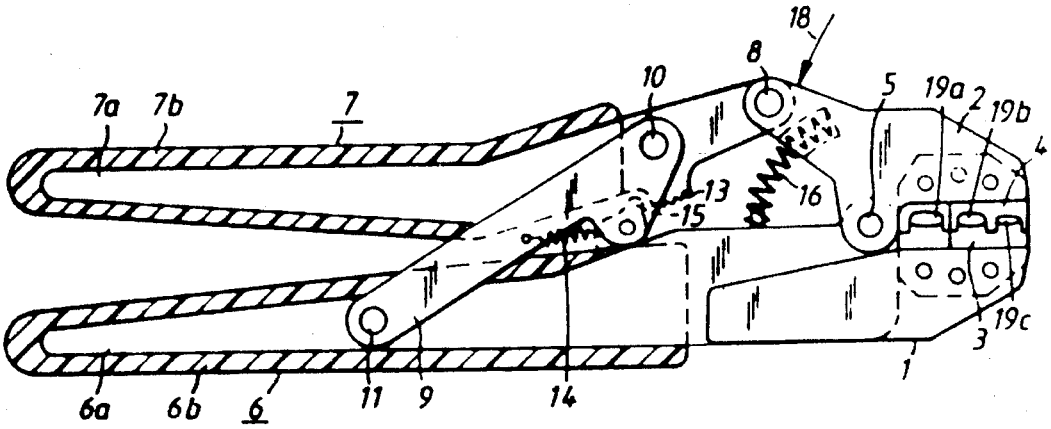

The tool illustrated in FIG. 3 is constructed in a similar manner to the tool illustrated in FIG. 1, with the exception that a pressure spring 16 acting between the handle 6 and the jaw 2 strives to hold the tool closed. The tool is opened fully by applying pressure in the manner indicated by the arrow 18, whereafter, for instance, a terminal contact is clamped firmly by introducing the terminal contact into a corresponding recess 19*a*, *b* or *c* in the crimping parts 3, 4 and then permitting the jaw 2 to swing back to its closed position under the action of the spring 16. The crimping operation is then completed, by moving the handles 6, 7 towards each other until the latching pawl 15 is located behind the toothed ring part 13.

Figure 4:
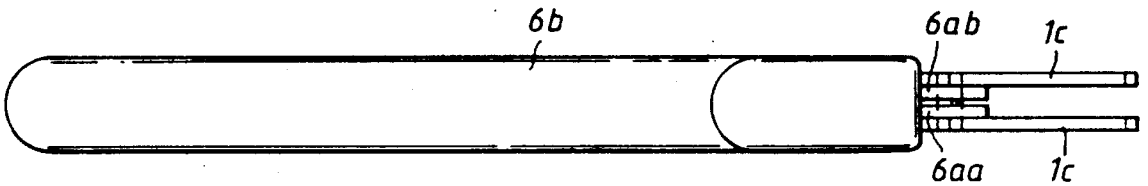
FIGS. 4–6 are respectively a view from beneath, a side view and a view from above of a fourth embodiment of the inventive crimping tool.
Figure 5:
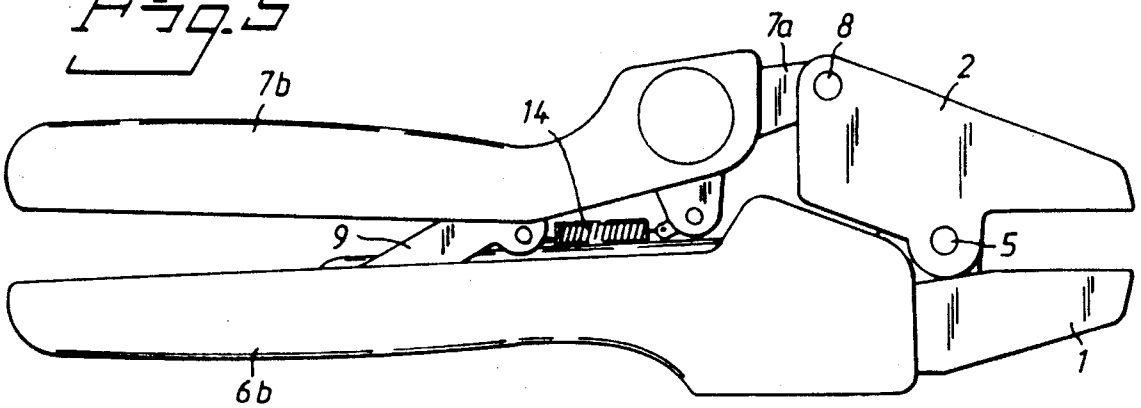
Figure 6:
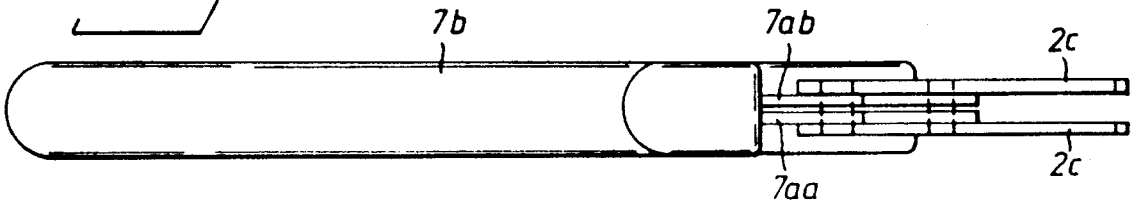

FIGS. 4–6 illustrate the manner of tool construction when the handle bodies have the form of double flat elements 6*aa*, 6*ab* and 7*aa*, 7*ab*. It will also be seen that the jaws 1 and 2 are constructed from sheet-like elements 1*c* and 2*c*. In other respects, the tool illustrated in FIGS. 4–6 is constructed in the same manner as that described with reference to FIG. 1.

Figure 7:
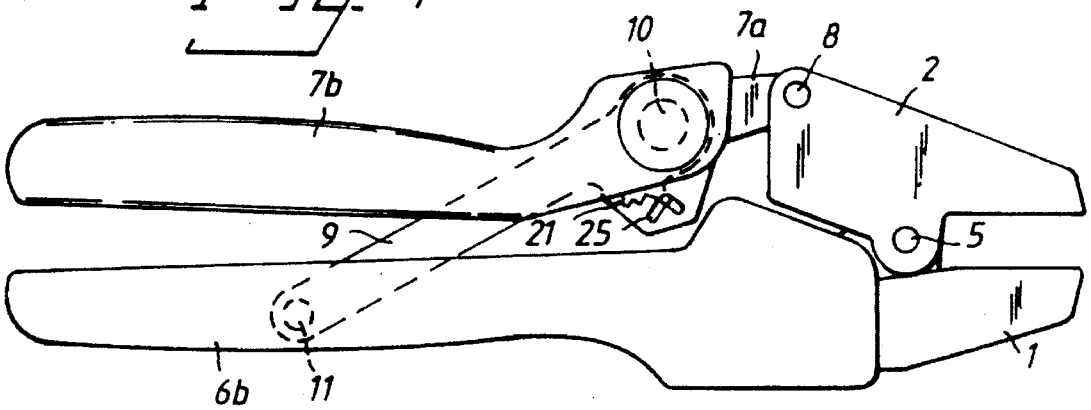
FIG. 7 shows in side view a fifth embodiment of the inventive crimping tool.

FIG. 7 illustrates a closed crimping tool resembling the tool illustrated in FIGS. 4 to 6. The tool of FIG. 7 is provided with a marking device 21 to 26 which, similar to the above described elements 13 to 15, can be adapted to prevent swinging of the handles 6, 7 in one direction before a swinging movement of the handles in an opposite direction has been completed. The construction of this type of marking device is shown in detail in FIGS. 8 to 10, while FIG. 11 shows a marking device which, although it indicates that a tool movement has been completed, does not prevent interruption of a tool movement before completion thereof. In the tool of FIG. 7, whose marking device 21 to 26 thus prevents interruption of a crimping operation before the jaws 1,2 have been swung to their fully closed position and prevents interruption of a tool opening movement, the linkage arms of the linkage construction 9 are provided with parts 20 having cams 21. These cams have an abruptly decreasing height at the ends thereof and a toothed camming surface 22 therebetween which is arcuately curved with the center of the arc in the point 10, as is clearly shown in FIGS. 8 and 9. Each cam 21 coacts with a cam follower 24 which is mounted in a generally V-shaped slot 25 formed in a part 23 of the handle body 7*a* and projects out from both sides of the said handle body. A spring 26 acting between the cam follower 24 and the point or pin 10 strives to pull the cam follower into the base-part of the V-shaped slot. It will be seen that the cam follower 24 must be located forwardly or rearwardly of the ends of the cams 21 before the tool can be opened and closed respectively, as is also evident from the above description of the elements 13 to 15. The legs of the slot 25 extend obliquely away from the camming surface 22. When that portion of the part 23 which carries the slot 25 is located between the ends of the camming surface 22, the cam 21 covers the base-part of the slot 25. Thus, when the part 23 moves to the left in FIG. 8, the cam follower 24 is cammed by the cam end-part into the rearward leg, as seen in the direction of movement. The cam follower 24 is held constantly in contact with the camming surface 22 by the action of the spring 26. When the movement has been completed, the cam follower 24 leaves the camming surface 22 and snaps down into contact with the base-part of the V-shaped slot 25, wherewith the arrangement may be constructed so as to obtain a visual indication or marking when the movement has been completed. Optionally, the described arrangement may be so constructed that the position of the cam follower 24 cannot be seen when the movement has been completed, or can only be seen with difficulty. In this regard, the indication may be solely an acoustic indication, i.e. the indication is given by the clicking sound produced when the cam follower 24 snaps down into contact with the base-part of the slot 25. When the part 23 moves back to the right in FIG. 9, the cam follower 24 is cammed into the now rearward slot leg. When the cam follower finally has passed along the entire camming surface 22, it again snaps down into the base-part of the slot 25 in the manner shown in FIG. 8.

The tool illustrated in FIG. 7 is opened automatically by the pull spring (not shown) acting between the jaw 2 and the handle 6. When performing a crimping operation, the articles concerned, for instance a terminal contact to be crimped onto the bared end of a cable, are inserted between the crimping parts (not shown) carried by the fully opened jaws 1,2, the handle 7 being swung upwards from the position illustrated in FIG. 7 in the manner illustrated in FIG. 9. While holding the articles manually in position between the jaws, the handles 6, 7 are swung towards one another until the slot 25 is located forwardly of the camming surface 22, as shown in FIG. 8, wherewith the crimping operation is completed.

Figure 8:
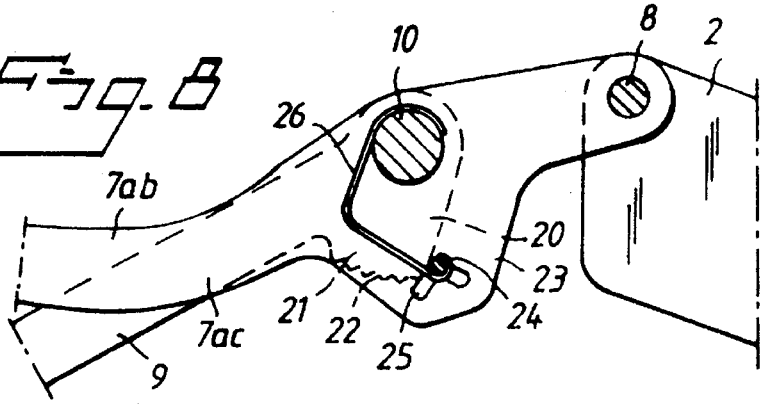
FIGS. 8 and 9 are central longitudinal sectional views in larger scale of a portion of the tool of FIG. 7 provided with a marking device which prevents the interruption of an initiated crimping tool movement prior to said movement being completed.
Figure 9:
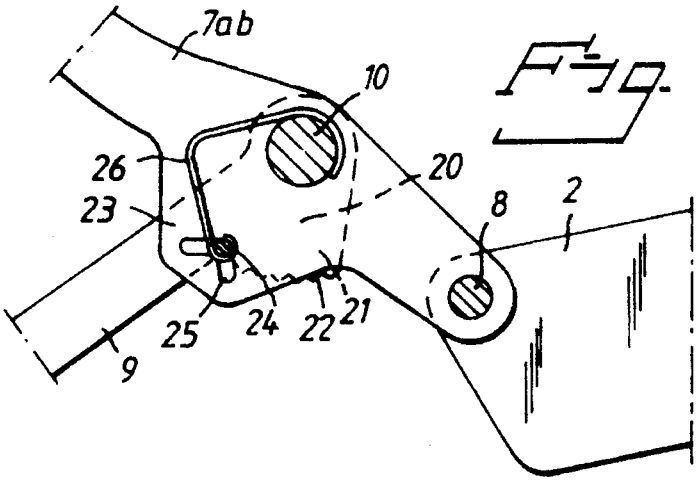

As before mentioned, FIGS. 8 and 9 are central longitudinal sectional views of the indicating or marking device of the tool according to FIG. 7. The section is thus taken between the body parts of the handle 7 so that only the body part 7*ab* and the one linkage arm 9 located therebeneath are visible. Both this body part 7*ab* and the upper body part (not shown in FIGS. 8 and 9) are provided with mutually opposite slots 25. The cam follower 25 extends through the two slots and the opposite ends of the cam follower coact with respective toothed camming surfaces 22 on each of the parts 20 of the linkage arms. The spring 26 is located between the mutually covering body parts 7*aa*, 7*ab* and is thus fully protected thereby. As is particularly evident from FIGS. 7 and 8, the portion 7*ac* of the handle 7 and the handle body 7*a*, respectively, located adjacent the shaft or point 10 extends substantially in parallel with the linkage arms 9. This arrangement in combination with the chosen mutual rations of the distances between the pivot points 5,8,10,11 results in a moderate, ergonomically favourable distance between the handles 6 and 7, both in the open and the closed position of said handles. As can be clearly seen in FIGS. 5 and 7, the handle covering 7*b* is extended forwardly to cover the pivot point or joint 10 which, as described above, suitably is associated with means for setting a desired closing position for the jaws 1,2 and adjusting said closing position when the tool becomes worn.

Figure 10:
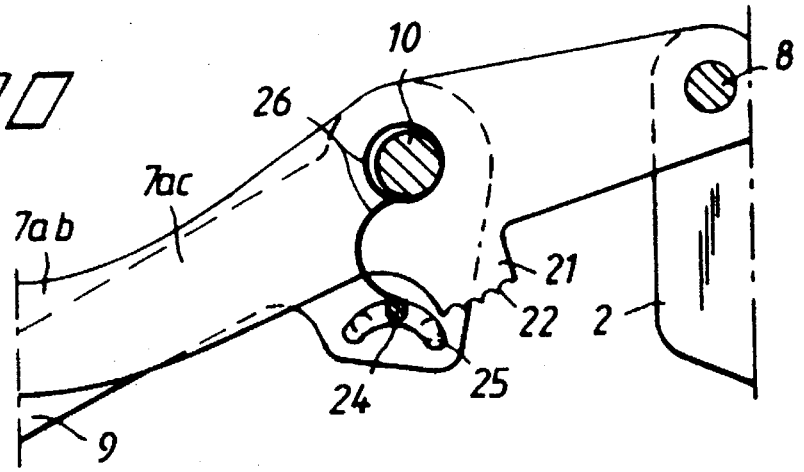
FIGS. 10 and 11 are views similar to the views of FIGS. 8 and 9 and illustrate alternative embodiments of the marking device.
Figure 11:
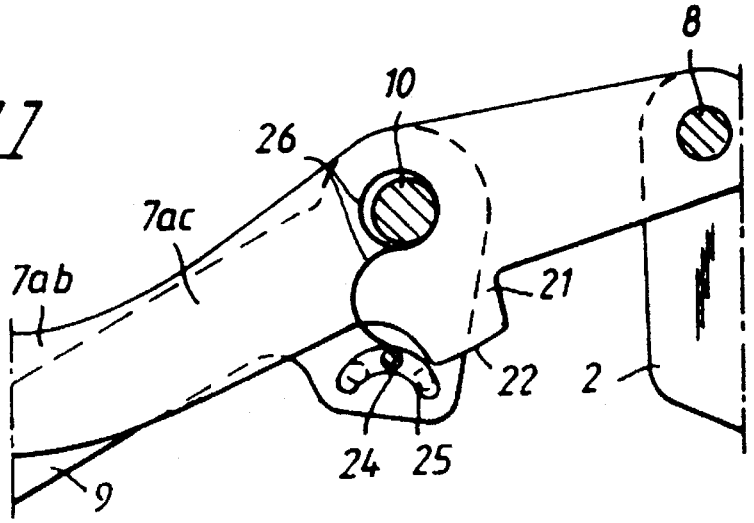

FIGS. 10 and 11 are views similar to FIG. 8. The cam 21, however, is mounted on the handle body 7*a*, whereas U-shaped slots 25 are disposed in the linkage construction 9. The cam follower 24 is guided at opposite ends thereof in the slots 25 in the linkage parts 9, while the center part of the cam follower is intended to coact with the cam 21 on the handle body 7*a* located between the linkage arms. Respective section views of FIGS. 10 and 11 are taken in the same way as the section views of FIGS. 8 and 9, and consequently only the bottom linkage arm and the body part 7*ab* located nearest thereto can be seen. The spring 26 acting between the cam follower 24 and the pivot pin 10 is fully protected between the body parts 7*aa*, 7*ab*. The cam surface 22 of the FIG. 10 embodiment is toothed and operates in the manner described with reference to FIGS. 7 to 9, whereas the cam surface of the FIG. 11 embodiment is smooth and does not prevent reversal of a tool movement before it has been completed.

The invention is not restricted to the aforedescribed and illustrated embodiments, but can be realized in any desired manner within the scope of the inventive concept defined in the following Claims.

We claim:

1. A crimping tool comprising first and second jaws (1, 2) each of which is provided with a crimping par% (3, 4) and which are journalled in a first pivot point (5) for relative pivotal movement between an open position and a closed crimping position, and which further comprises first and second handles (6, 7) for pivoting the jaws and extending rearwardly from said jaws (1, 2), of which handles the first handle (6) is rigidly connected at a forward end to the first jaw (1), whereas the second handle (7) is pivotally connected to at least a part of the second jaw (2) at a forward end in a second pivot point (8) located rearwardly of the first pivot point (5), and further comprises a link construction (9) which extends obliquely rearwards from the a third pivot point (10) located on the second handle (7) rearwardly of the second pivot point (8), to a fourth pivot point (11) located on the first handle (6), characterized in that the distance (D) between the first and the second pivot points (5, 8) is 0.30–0.35 times the distance (A) between the first and the fourth pivot points (5, 11), the distance (C) between the second and the third pivot points (8, 10) is 0.20–0.25 times the distance (A) between the first and the fourth pivot points (5, 11), and the distance (B) between the third and the fourth pivot points (10, 11) is 0.62–0.66 times the distance (A) between the first and the fourth pivot points (5, 11); and in that when the jaws (1, 2) are in their crimping position a plane (E) which contains the second and the third pivot points (8, 10) defines an angle (α) within the range of 165°–180° with a plane (F) which contains the third and the fourth pivot points (10, 11) with the apex of the angle facing away from a plane (G) which contains the first and the fourth pivot points (5, 11).

2. A crimping tool according to claim 1, characterized in that the distance (D) between the first and the second pivot points (5, 8) is about 0.32 times the distance (A) between the first and the fourth pivot points (5, 11); in that the distance (C) between the second and the third pivot points (8, 10) is about 0.24 times the distance (A) between the first and the fourth pivot points (5, 11); and in that the distance (B) between the third and the fourth pivot points (10, 11) is about 0.64 times the distance (A) between the first and the fourth pivot points (5, 11).

3. A crimping tool according to claim 1, characterized in that the tool has intrinsic spring properties such that the jaws (1, 2) when brought to a closed crimping position by the handles (6, 7) can be swung apart through an angle of 5°, preferably about 10° without residual deformation of the tool.

4. A crimping tool according to claim 1, characterized in that it includes handle bodies (6*a*, 7*a*) which are located in mutually the same plane; and in that the linkage construction (9) includes two mutually parallel link arms, each of which is located on a respective side of the handle bodies.

5. A crimping tool according to claim 4, characterized in that a portion (7*ac*) of the second handle body (7*a*) located rearwardly of said third pivot point (10) is located between and extends substantially in parallel with said link arms (9), whereafter said body (7*a*) is curved so as to extend substantially in parallel with said first handle (6).

6. A crimping tool according to claim 5, characterized in that said portion (7*ac*) of the second handle body (7*a*) has a length of the order of magnitude of half the distance between said third and fourth pivot points (10, 11).

7. A crimping tool according to claim 1, characterized in that the first jaw (1) includes two plates (1*c*) each of which is connected to a respective side of the first handle body (6*a*), and a crimping part (3) mounted between said plates.

8. A crimping tool according to claim 1, characterized in that the second jaw (2) includes two plates (2*c*), each of which is pivotally journalled to a respective side of the first handle body (6*a*), and a crimping part (4) mounted between said plates.

9. A crimping tool according to claim 1, characterized in that the tool is spring biased towards an open position by means of a pull spring (12) which acts between the second jaw (2) and the first handle (6).

10. A crimping tool according to claim 1, characterized in that the second crimping jaw (2) includes a first jaw part (2*a*) in the form of a linkage arrangement extending between the first and the second pivot points (5, 8), and a second jaw part (2*b*) which is provided with said crimping part (4) and which is journalled at the first pivot point (5) and which is spring biased towards the closed position and is provided with a recess (17) for receiving a shaft which extends through the second pivot point (8) and which functions to press the second jaw part (2*b*) towards said closed crimping position when the handles (6, 7) are swung towards a jaw closing position.

11. A crimping tool according to claim 10, characterized in that the tool is spring biased towards said closed position by means of a pressure spring (16) acting between the first and the second jaw parts (2*a*, *b*).

12. A crimping tool according to claim 1, characterized in that the tool is spring biased towards said closed position and can be opened by applying pressure to the tool in the region of the second pivot point (8) in a direction towards the first handle (6).

13. A crimping tool according to claim 1, characterized in that the tool is provided with a marking device (13–15; 20–26) for indicating that a tool movement between open and closed positions or vice versa has been completed.

14. A crimping tool according to claim 13, characterized in that the marking device (13–15; 20–26) is of the type which, before completion of a commenced swinging movement of the handles (6, 7) in one direction, prevents swinging of the handles in the opposite direction.

15. A crimping tool according to claim 13, characterized in that the marking device (20–26) includes a cam (21) carried by a first tool part, said cam having a camming surface (22), suitably having an abruptly decreasing height at mutually opposite ends thereof, and a cam follower (24) carried by a second tool part which is pivotal in relation to said first tool part, wherein the cam follower is spring-biassed towards the camming surface (22) and projects outwardly of and is mounted for movement along an essentially U-shaped or V-shaped guide or slot (25) formed in said second tool part adjacent said cam (21), the legs of which slot extend away from the cam (21) and the base-part of which is at least partially covered by the cam in the region of movement of the tool parts between said open and closed positions; and in that the cam follower (24) is intended to be cammed by said cam ends into the rearward leg of the U-shaped or V-shaped slot, as seen in the relative direction of movement of said second tool part, and to be held therein by the intermediate camming surface (22) extending between said cam ends, until said movement has been completed.

16. A crimping tool according to claim 15, characterized in that the intermediate camming surface (22) is toothed, such that movement of said tool parts in one direction must be completed before movement of said parts in an opposite direction can begin.

17. A crimping tool according to claim 15, characterized in that the intermediate camming surface (22) is convex arcuate; and in that the part (20) carrying the cam (21) is pivotal about a pivot center (10) which coincides with the center point of the arc.

18. A crimping tool according to claim 17, characterized in that the tool part carrying the cam (21) is pivotal about a pivot pin (10); and in that the cam follower (24) is spring-biassed by means of a spring device (26) which acts between the cam follower and the pivot pin.

19. A crimping tool according to claim 18, characterized in that the cam (21) is mounted on the linkage construction (9) and the cam follower (24) is mounted on said second handle (7) or vice versa.

20. A crimping tool according to claim 4, characterized in that the tool includes handle bodies (6*a*, 7*a*) which are located in mutually the same plane; in that the linkage construction (9) includes two mutually parallel linkage arms, each of which is located on a respective side of said handle bodies (6*a*, 7*a*); and in that the cam follower (24) is mounted-in a generally U-shaped or V-shaped slot (25) in and projects out from both sides or the second handle body (7*a*), and in that the linkage arms each have cam parts (22) which are located on a respective side of the handle body for engagement with the cam follower (24) and which are at least generally arcuate with the center of curvature located on the linkage arm pivot point (10) in the body (7*a*) of the second handle (7).

21. A crimping tool according to claim 20, characterized in that at least the body of the second handle (7) is comprised of two mutually parallel body parts (7*aa*, 7*ab*) which are spaced slightly apart and which contain mutually opposing, essentially U-shaped or V-shaped slots (25) through which the cam follower (24) extends; and in that a spring (26) which acts between the cam follower and a pivot pin (10) by means of which the linkage arms are journalled to the body of the second handle (7) , is located between the body parts ( 7*aa*, 7*ab*) and strives to hold the cam follower (24) in engagement with the base-part of the U-shaped or V-shaped slot (25).

* * * * *